US006615512B2

(12) United States Patent
Sink

(10) Patent No.: US 6,615,512 B2
(45) Date of Patent: Sep. 9, 2003

(54) SPIKELESS GOLF SHOE HAVING AN OUTSOLE WITH BI-DIRECTIONAL SURFACE REACTION BODY

(76) Inventor: Jeffrey A. Sink, 154 Santiago Ave., Redwood City, CA (US) 94061

( * ) Notice: Subject to any disclaimer, the term of this patent is extended or adjusted under 35 U.S.C. 154(b) by 0 days.

(21) Appl. No.: 09/982,117

(22) Filed: Oct. 17, 2001

(65) Prior Publication Data

US 2002/0166263 A1 Nov. 14, 2002

Related U.S. Application Data

(63) Continuation of application No. 09/800,427, filed on Mar. 6, 2001, now abandoned.

(60) Provisional application No. 60/048,836, filed on Jun. 6, 1997.

(51) Int. Cl.[7] ..... A43B 5/00

(52) U.S. Cl. ..... 36/127; 36/59 C; 36/59 R; D2/951

(58) Field of Search ..... 36/67 R, 127, 36/134, 59 R, 59 C; D2/906, 908, 951, 962

(56) References Cited

U.S. PATENT DOCUMENTS

| | | | | | |
|---|---|---|---|---|---|
| 299,691 | A | | 6/1884 | Smith | |
| 736,082 | A | * | 8/1903 | Foreman et al. | 36/59 R |
| 1,355,827 | A | * | 10/1920 | Finneran | 36/59 R |
| 2,216,645 | A | * | 10/1940 | Mastrandrea | 36/59 R |
| 2,722,756 | A | | 11/1955 | Ecclesine | |
| 4,327,503 | A | | 5/1982 | Johnson | |
| 4,372,058 | A | | 2/1983 | Stubblefield | |
| 4,578,883 | A | * | 4/1986 | Dassler | 36/116 |
| 4,642,917 | A | * | 2/1987 | Ungar | 36/59 C |
| 4,667,425 | A | * | 5/1987 | Effler et al. | 36/126 |
| 4,741,114 | A | | 5/1988 | Stubblefield | |
| 5,203,097 | A | | 4/1993 | Blair | |
| 5,483,760 | A | | 1/1996 | Kataoka et al. | |
| 5,509,218 | A | | 4/1996 | Arcan et al. | |
| 5,581,913 | A | | 12/1996 | Kataoka et al. | |
| 5,689,904 | A | | 11/1997 | Kataoka et al. | |
| 5,752,332 | A | | 5/1998 | Kataoka et al. | |
| 5,761,832 | A | | 6/1998 | George | |
| 5,943,794 | A | * | 8/1999 | Gelsomini | 36/127 |
| 6,016,613 | A | * | 1/2000 | Campbell et al. | 36/59 C |

* cited by examiner

*Primary Examiner*—M. D. Patterson
(74) *Attorney, Agent, or Firm*—Burns, Doane, Swecker & Mathis, LLP

(57) ABSTRACT

A spikeless golf shoe includes an upper portion and an outsole portion which further includes a front portion and a heel portion. The outsole portion includes several rows of approximately trapezoidal shaped interconnected cleats designed so that the golfer is provided with stability and traction during a golf swing, traction while walking up an incline, stability while walking on a firm surface other than grass and increased flexibility and comfort. The cleats are also reduce or eliminate the spike mark problems to grass surfaces and reduce the accumulation of debris within the cleats. Several rows of cleats are positioned along the inner and outer periphery of the outsole portion and are oriented so that substantial traction is provided during a golf swing as well as allowing the golf shoe to roll during the follow through of a golf swing.

19 Claims, 7 Drawing Sheets

SPIKELESS GOLF SHOE HAVING AN OUTSOLE WITH BI-DIRECTIONAL SURFACE REACTION BODY

CROSS REFERENCE TO RELATED APPLICATIONS

This is a continuation of application Ser. No. 09/800,427 filed Mar. 6, 2001 now abandoned. The present application is related to provisional patent application Ser. No. 60/048,836, filed Jun. 6, 1997 entitled "Spikeless Golf Shoe", and the benefit of the earlier Jun. 6, 1997 filing date is claimed for the present application in accordance with 35 U.S.C. §119 (e)(1).

BACKGROUND OF THE INVENTION

The present invention relates generally to golf shoes and more particularly to spikeless golf shoes.

Historically in the golfing industry, golfers have used shoes in which an array of screw holes were embedded into the shoe sole to accept an equivalent number of golf spikes. The golf spike tips are typically made of a hardened metal such as tungsten and are contained within a circular housing having a nub portion. These spikes are screwed into the screw holes and can be removed or replaced, as needed, using a special golf wrench tool. A standard golf shoe typically has between ten and twelve golf spikes for each shoe. These spikes provide traction for a golfer during a golf swing.

A major problem with these types of golf spikes is that the spikes and the nub portion can leave what are called spike marks (or holes) on the grass surface of a golf course, particularly on the putting surfaces (called the "green" or the "putting green"). A careless golfer who shuffles or twists his feet while walking across a putting green can damage the grass surface. Even a careful golfer can leave spike marks on a putting green, particularly when the putting green is wet.

Current golf rules permit the repair of golf ball marks on the putting green, such as the mark left when a golf ball hits the putting green. However, those current golf rules do not permit the repair of spike marks. It is well known that the spike marks that golf spikes make on the putting surface can dramatically affect the motion or path of a putted golf ball, and as a result, the golfer's overall score. Many golf courses have subsequently banned the uses of traditional spiked golf shoes for these reasons.

Initially, some golf courses permitted the use of certain types of spikeless golf shoes, hoping to minimize the spike marks left by spiked golf shoes. Some versions of those spikeless golf shoes incorporated an array of circular rubber knobs which were to provide the desired traction similar to the traditional spiked golf shoes, but tended to leave knob marks on the putting greens. In some instances, more severe marks were caused by these types of spikeless golf shoe. As a result, more golf courses have banned the use of these type of spikeless golf shoe as well.

There are presently available spikeless golf shoes in which circular cleats (typically plastic) replace the traditional golf spikes, again using some form of golf wrench tool to remove the golf spikes and replace those golf spikes with the circular cleats. Each circular cleat typically has a series of pin-like projections or a circular array of triangular shaped nubs which serve to provide traction during a golf swing. However, these circular type of spikeless golf cleats can still leave undesired marks on the putting surface, particularly in wet conditions.

Another problem with existing golf shoes is that the outsole portion (the bottom) of the golf shoe tends to accumulate dirt and debris, especially during wet conditions. The accumulation of such dirt and debris requires frequent and tedious cleaning, as otherwise the desired traction during a golf swing can be affected.

In view of the foregoing, there is a need for an improved spikeless golf shoe which will eliminate or minimize the type of spike marks presently left on the grass surfaces and particularly the putting surfaces while still providing the necessary traction during a golf swing, and minimizing the accumulation of dirt and debris.

SUMMARY OF THE INVENTION

It is an object of the present invention to provide an improved spikeless golf shoe.

In one preferred embodiment, the present invention provides an outsole for use with a shoe intended for wearing on a surface such as natural or artificial grass while the user is engaged in sports or other energetic activities. The outsole comprises an elongate sole structure having a bottom; a traction stricture depending below the bottom, the traction structure comprising at least one bi-directional surface reaction body having a first face and a second face, the bi-directional surface reaction body having an apex portion which merges with the first and second faces; the first face extends upwardly from the apex portion and joins with the bottom at a first angle which is sufficiently upright relative to the bottom to enable the first face to create substantial traction with the surface responsive to force components which are applied against the shoe for urging the bi-directional body in one horizontal direction; and the second face extends upwardly from the apex portion and joins with the bottom at a second angle which is sufficiently inclined relative to the bottom to enable the second face to have insubstantial traction with the surface responsive to force components which are applied against the shoe for urging the bi-directional surface reaction body in an other horizontal direction.

Stated in another way, the spikeless golf shoe according to the present invention includes an upper portion and an outsole portion. The outsole portion includes a front sole portion and a heel portion. The outsole portion further includes a first row of trapezoidal shaped, interconnecting cleats formed on or near the outer periphery of the front sole portion. In one embodiment, the first row of cleats extend from the near the front of the sole portion past the ball portion to approximately the arch portion o the outsole. In other embodiments, the first row of cleats extend further to the front of the heel portion. The first row of cleats are configured so that the outer approximately 90° face of each of the cleats provides substantial traction during a golf swing. The present invention includes a second row of cleats similar in configuration to the first row of cleats and spaced apart or offset from the first row of cleats. The second row of cleats aids in providing additional traction while minimizing the accumulation of mud and/or debris.

In another embodiment, the spikeless golf shoe according to the present invention also includes a third row of trapezoidal shaped, interconnecting cleats formed on the inner periphery of the front sole portion. The third row of cleats are configured so that the outer approximately 45° face of each cleat provides for the rolling action of the golf shoe during the follow through of the golf swing. The cumulative top surface area of all cleats provides a sufficient gripping action when in contact with grass and provides adequate support when worn on a solid surface. Each of the cleats are of a sufficient height so as to maintain a sufficient gripping action when in contact with grass as well as minimize the damage done when in contact with the grass area. The present invention further includes a fourth row of interconnecting cleats offset from the third row; at least one front individual lateral cleat located near the front of the sole portion to provide traction; a series of individual non-interconnected lateral cleats located in the front sole portion; a series of individual non-interconnected lateral cleats located on the heel section; and slots dividing or separating the interconnecting cleats.

Other objects, features and advantages of the present invention will become apparent from the following detail when taken in conjunction with the accompanying drawings.

BRIEF DESCRIPTION OF THE DRAWINGS

The accompanying drawings, which are incorporated in and form a part of this specification, illustrate embodiments of the invention and together with the description, serve to explain the principles of the invention:

FIG. 4 shows the cross section for a right shoe only.

FIG. 5A shows a right shoe only.

DETAILED DESCRIPTION OF THE PREFERRED EMBODIMENTS

Referring now to the accompanying drawings, reference will now be made in detail to the preferred embodiments of the invention. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention.

As will be described, in one preferred embodiment, the present invention provides an outsole for use with a shoe intended for wearing on a surface such as natural or artificial grass while the user is engaged in sports or other energetic activities. The outsole comprises an elongate sole structure having a bottom; a traction structure depending below the bottom, the traction structure comprising at least one bi-directional surface reaction body having a first face and a second face, the bi-directional surface reaction body having an apex portion which merges with the first and second faces; the first face extends upwardly from the apex portion and joins with the bottom at a first angle which is sufficiently upright relative to the bottom to enable the first face to create substantial traction with the surface responsive to force components which are applied against the shoe for urging the bi-directional body in one horizontal direction; and the second face extends upwardly from the apex portion and joins with the bottom at a second angle which is sufficiently inclined relative to the bottom to enable the second face to have insubstantial traction with the surface responsive to force components which are applied against the shoe for urging the bi-directional surface reaction body in an other horizontal direction.

Figure 1:
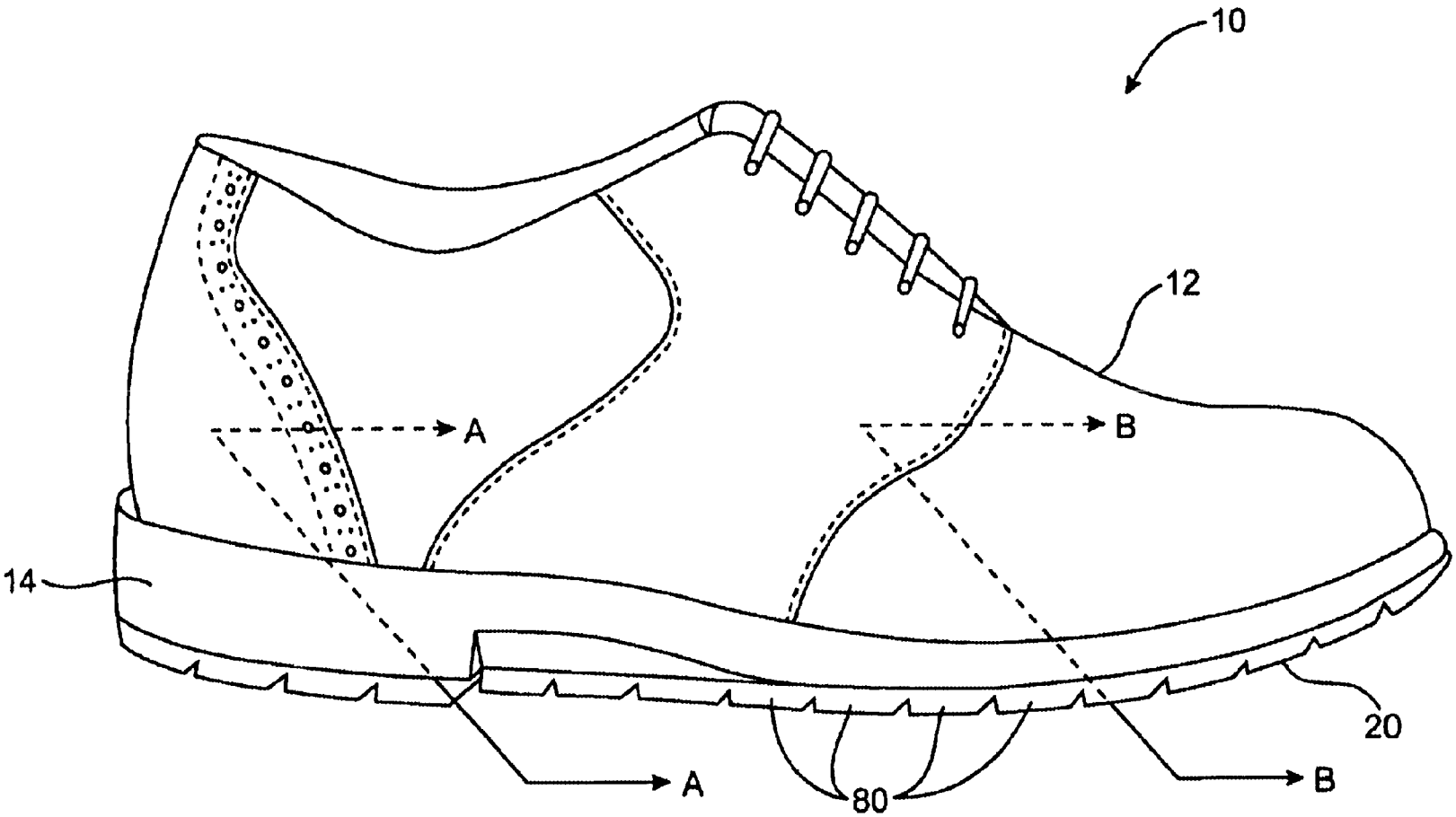
FIG. 1 is a side elevation view of a spikeless golf shoe according to the present invention, indicating section marks A—A and B—B which are referred to in subsequent Figures.

Referring now to FIG. 1, a side view of a spikeless golf shoe 10 according to the present invention is shown. The upper portion of the golf shoe 12 is typically fabricated from stitched fabric, leather, canvas or other types of synthetic or natural materials. In some embodiments, the upper portion of the golf shoe also includes a middle portion or midsole 14, typically made of a foam or rubber material. The spikeless golf shoe 10 also includes a bottom outsole 20 which is attached to the bottom of the upper portion 12. The outsole portion comprising a traction structure includes both individual and rows of bi-directional surface reaction bodies or cleats 80 which are formed on outsole 20, and will be described in more detail in FIGS. 6A, 6B, 6C and 6D.

Figure 2:
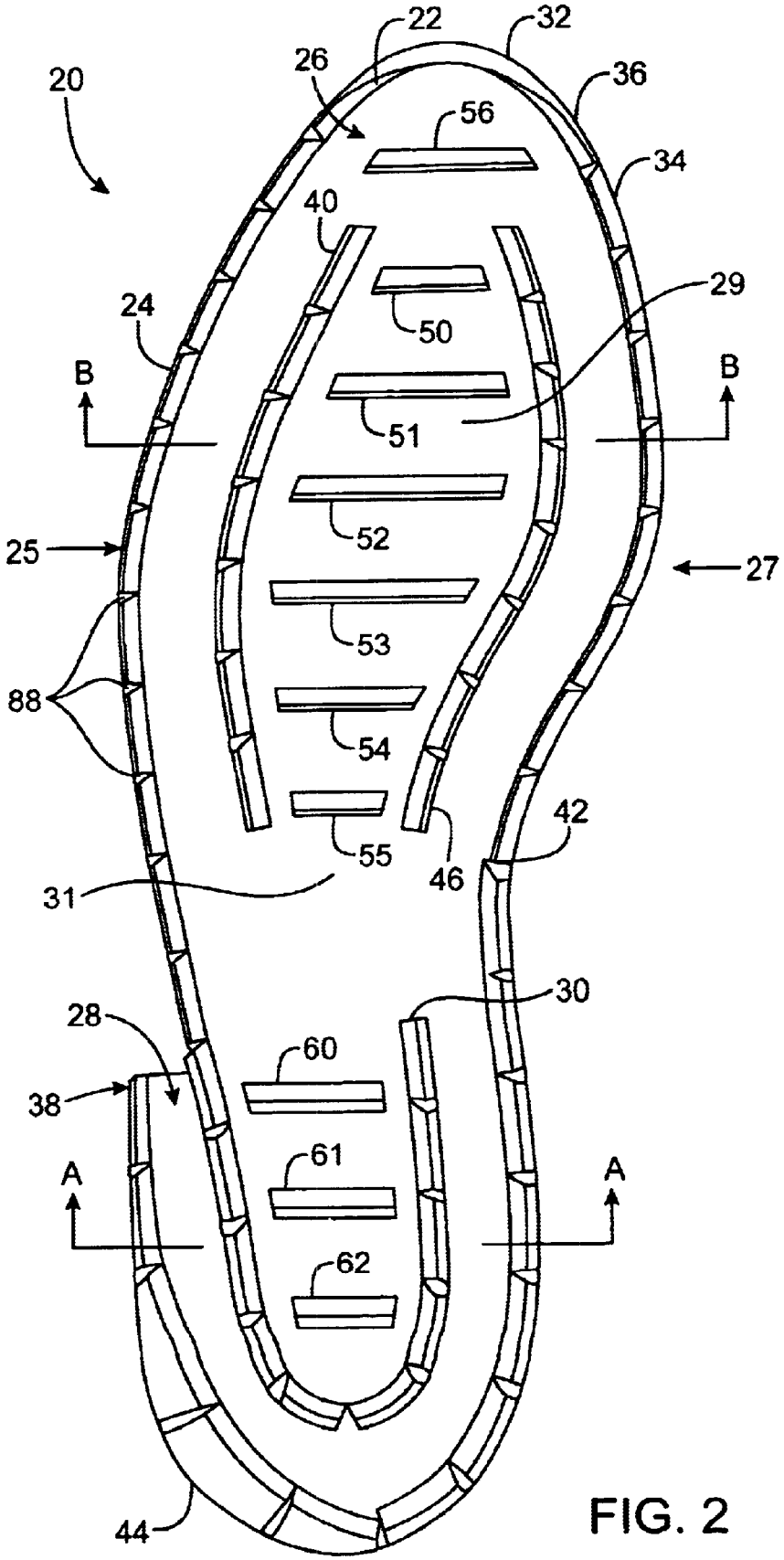
FIG. 2 is a bottom plan view of the outsole of the spikeless golf shoe shown in FIG. 1, indicating section marks A—A and B—B which are referred to in subsequent Figures.

The cleat configuration 80 is shown in more detail in FIG. 2. As will be described, the cleat arrangement 80 provides the spikeless golf shoe 10 with the ability to maintain traction during a golf swing, allow the shoe to roll during the follow through of a golf swing while minimizing the potential damage caused to putting and other grass surfaces. Additionally, the cleat arrangement minimizes the accumulation of debris on the outsole.

FIG. 2 shows a bottom view of the outsole 20 described in FIG. 1 in which one or more rows of cleats are formed on the bottom of outsole 20. In one preferred embodiment, there are four rows of cleats 24, 40, 46, 34 formed on the bottom of outsole 20. As shown in FIG. 1, outsole 20 includes a front portion 26 and a heel portion 28. For description purposes, the "outer periphery" 25 of the outsole 20 refers to the lateral side which faces or is on the outside of the user's foot when looking down. Hence, the outer periphery for a pair of golf shoes would be the right hand side on the right foot and the left hand side on the left foot.

Likewise, the term "inner periphery" 27 of the outsole 20 refers to the medial side of the outsole which faces the inside of the user's foot. Since FIG. 2 is a bottom view of an outsole for a right spikeless golf shoe, the outer periphery is depicted on the left side of FIG. 2 and the inner periphery is depicted on the right side of FIG. 2. This scheme would be opposite for a bottom view of a left outsole.

In FIG. 2, a first row of cleats 24 is formed on or near the outer periphery 25 of outsole 20 beginning at or near location 22 and extends or continues lengthwise along the outer periphery 25 of outsole 20 toward the heel portion 28. In one embodiment, the first row of cleats 24 on outsole 20 continues around an internally offset circumference of the heel portion 28 and ends at location 30. However, the row of cleats 24 could extend lengthwise from the front portion past the ball portion 29 to approximately the arch portion 31 in order to provide sufficient traction during a golf swing. Other variations of the arrangement of the first row of cleats 24 are also possible.

The length and orientation of the first row of cleats 24 is constructed so as to provide a sufficient amount of traction to a golfer during a golf swing while simultaneously minimizing the "spike mark" effect on putting and other grass surfaces.

In a preferred embodiment, a second row of cleats 40 is offset and extends lengthwise approximately parallel to the first row of cleats 24. The second row of cleats 40 extends from near the top of front portion 26 of outsole 20 to near the top of the heel portion 28 of outsole 20. The length and orientation of the second row of cleats 40 provides increased traction during a golf swing while minimizing damage to putting and other grass surfaces.

In FIG. 2, a third row of cleats 34 is formed on or near the inner periphery of the outsole 20 beginning at or near location 32 and continuing along the inner periphery of outsole 20 toward the heel portion 28. In one preferred embodiment, the third row of cleats continues around the circumference of heel portion 28 and ends at location 38. The length and orientation of the third row of cleats 34 allows adequate rolling action during the follow through of a golf swing as well as a measure of traction during the back swing while also minimizing damage ("spike marks") to putting and other grass surfaces. The portion of row 34 beginning at location 32 along the inner periphery of outsole 20 and ending at location 42 allows for the rolling action required during the follow through of a golf swing while the portion of row 34 beginning at location 42 along the circumference of the heel portion 28 and ending at location 38 provides for increased traction during a golf swing.

Outsole 20 has a fourth row of cleats 46 offset and approximately parallel to the third row of cleats 34. The fourth row of cleats 46 extends from near the top of front portion 26 of outsole 20 to near the top of the heel portion 28 of outsole 20. The length and orientation of the fourth row of cleats 46 provides increased traction during a golf swing while minimizing damage to putting and other grass surfaces.

In FIG. 2, a series of individual laterally or widthwise placed cleats 50, 51, 52, 53, 54, 55 are spaced apart from one another along the front portion 26 of outsole 20. Another series of individual laterally or widthwise placed cleats 60, 61, 62 are spaced along the heel portion 28 of outsole 20. A single laterally or widthwise placed cleat 56 is located near the top of the front portion 26. These series of lateral or widthwise cleats provide traction to a golfer while walking on a flat or graded surface.

During a golf swing, both feet of a golfer tend to be pushed outward from the center of the golfer's body resulting from the force translated down the golfer's legs. This results in an instability which can cause a golfer to swing improperly and hit a golf ball poorly. At the same time, the golf shoes must be able to roll during the follow through of a swing. In the last stages of a golf swing (the followthrough), the back foot (the right foot for a right handed golfer and the left foot for a left handed golfer) must roll across the ball of the foot to ensure a proper followthrough to complete the golf swing. It is thus important that a golf shoe provide enough traction during a golf swing to allow a golfer to properly strike the ball while allowing the back foot to roll during the followthrough. The individual cleats and rows of cleats in the present invention are designed to provide this traction during a swing as well as allowing for adequate rolling action during the followthrough of a golf swing.

Figure 6A:
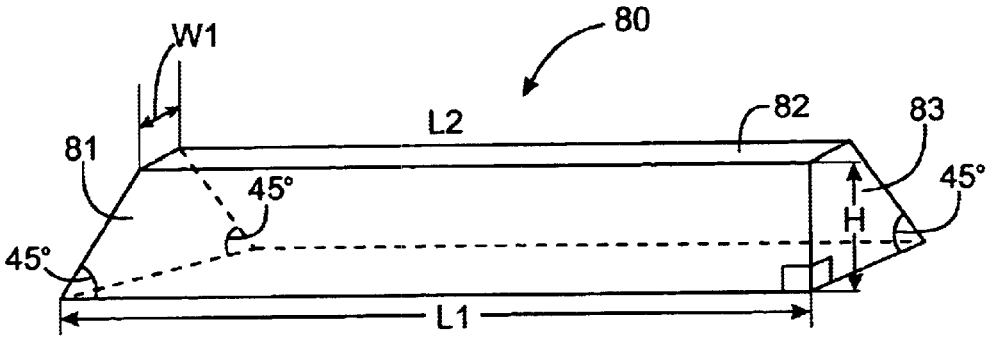
FIGS. 6A, 6B and 6C shows the geometrical shape of an individual cleat which is formed on the bottom of the outsole of FIG. 2.
Figure 6B:
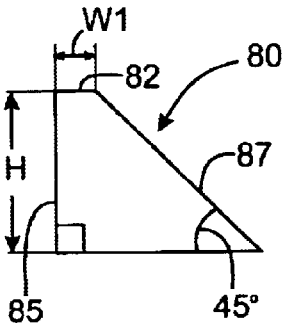
Figure 6C:
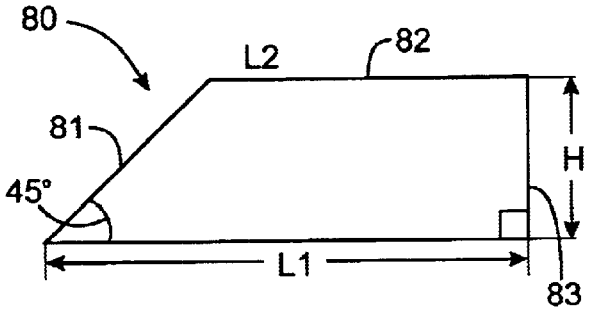

FIG. 6A shows an isometric view of an individual cleat 80 according to the present invention. Cleat 80 is generally a six sided polyhedron with trapezoidal cross-sections both lengthwise and widthwise. As referred to in this description, apex portion or top face 82 is the side of the cleat which is in initial contact with the grass surface and thus on the very bottom of the shoe when being worn by a golfer. The front face 81 shown in FIG. 6A is the side of the cleat 80 which is positioned toward the front of the golf shoe 10 in FIG. 1. The back face 83 shown in FIG. 6A is the side of the cleat 80 which is positioned toward the rear of the golf shoe 10 in FIG. 1. The outer face 85 shown in FIG. 6B of the cleat 80 is the side of the cleat which is closest to the periphery of the outsole 20. The inner face 87 shown in FIG. 6A of the cleat 80 is the side of the cleat which is closest to the center of the golf shoe 10 or outsole 20. The cleat 80 in FIG. 6A has the inner face 87 forming approximately a 450° angle with the outsole 20 and the outer face 85 forms approximately a 90° angle with the outsole 20. Likewise, the front face 81 of the cleat 80 forms approximately a 45° angle with the outsole 20 and the back face 83 forms approximately a 90° angle with the outsole 20. This geometry provides the trapezoidal cross-section in both lengthwise and widthwise directions. FIG. 6B shows a widthwise cross-section of the cleat 80 with the corresponding 90° and 45° angles. FIG. 6C shows a lengthwise cross-section of the cleat 80 with the corresponding 90° and 45° angles.

As an example, a typical cleat 80 as depicted in FIGS. 6A, 6B and 6C would have a height H of approximately ⅛", the length L1 at the base of cleat 80 would be approximately ¾", the length L2 at the top of cleat 80 would be approximately ⅝", slightly shorter than L1. The width W1 of top face 82 would be approximately 1/16". These dimensions are representative of a typical cleat and are not meant to be limiting. The general dimensions lengthwise and widthwise of the spikeless cleats could vary depending on the placement on the outsole and the specific purpose of the cleat. For example, the length of each individual cleat could be longer than the lengths L1 and L2, and yet still provide the desirable features of the present invention. In FIG. 6B, it can be seen that the cross sectional view of cleat 80 is substantially triangular, in that an extension of faces 87 and 85 would form a vertex of a triangle. The cleat 80 in FIG. 6B is suitable for a spikeless golf shoe which includes an outsole having a first row and a second row of spikeless cleats such as cleat 80 wherein the spikeless cleats are substantially triangular in cross section with one leg of the respective triangle approximately perpendicular to the outsole to form a 90° leg and another leg of the respective triangle being at approximately 45° to the outsole to form a 45° leg; wherein the first row of cleats includes at least two spikeless cleats disposed on the outside lateral edge of the outsole; the outsole further having the second row including at least two spikeless cleats disposed substantially parallel to and spaced apart from said first row of cleats on the outside lateral edge side of the outsole.

The 90°/45° configuration of the cleats supplies both the traction and rolling action in grass, whether wet or dry. When a force is applied against the 90° face (such as during the back swing of a golf swing), the cleat opposes this force and provides traction to the golfer. When a force is applied against the 45° face, the cleat does not oppose this force to the extent that the 90° face does. When a golfer is finishing his swing (the followthrough) and requires his back foot to roll, the location of this 45° face on the inner periphery of the outsole allows this rolling action to occur with less resistance. At the same time, during the execution of the golf swing, the 90° face on the other side of the 45° face continues to provide traction.

The first row of cleats 24 as shown in FIG. 2 is arranged so that the outer face of the cleats has the 90° angle configuration and the inner face has the 45° angle configuration. Since the force during a golf swing is applied toward the outer periphery of the golf shoe 10 and outsole 20, this arrangement provides for traction during a golf swing.

For a right handed golfer, the rolling action required during the follow through of a golf swing is on the inner periphery of the right foot. FIG. 2 depicts the bottom view of an outsole for a right shoe. The row of cleats 34, as shown in FIG. 2, is arranged so that the inner face of the cleats has the 90° configuration and the outer face of the cleats has the 45° configuration. Locating the 45° face on the outer face of the cleats in row 34 reduces the amount of resistance caused by the cleat in this area during the follow through of a golf swing and allows the golf shoe to roll about the ball of the foot. This enables the golfer to properly complete his or her swing.

Figure 7:
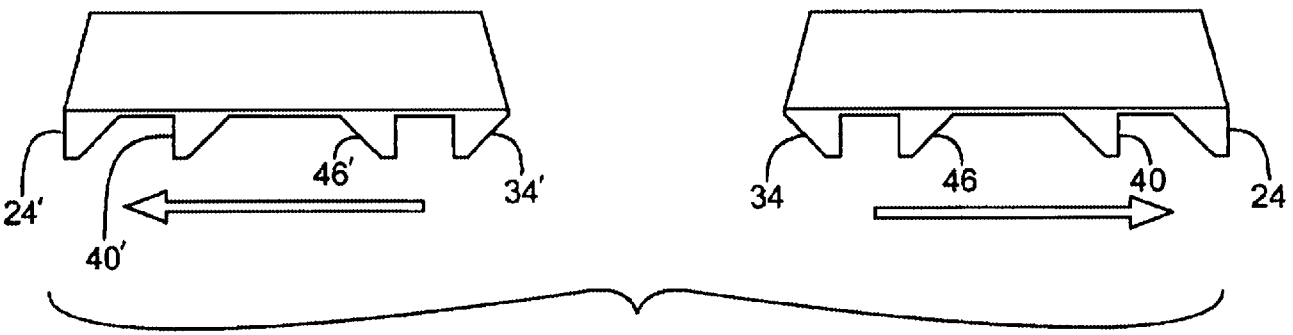
FIG. 7 shows a cross sectional view of a pair of golf shoes (left and right shoes) at section mark B—B during the beginning of a golf swing with arrows representing the direction of the force applied to the shoes.

Since the outsoles on a pair of spikeless golf shoes are mirror images of each other, the mechanics of the spikeless golf shoe are reversed for a left-handed golfer, with the 45° face of the cleats which provide the rolling action on the inside of the left foot. FIG. 7 shows a cross section of the outsole 20 shown in FIG. 1 at section B—B as well as a similar cross section for an outsole for a left shoe. In FIG. 7, a pair of outsoles are shown as would be typically worn by a golfer. As can be seen in FIG. 7, the cleat layouts for the right and left shoes are mirror images of each other, thereby providing equal utility for either a right-handed or left-handed golfer. The arrows represent the force applied on each of the outsoles 20 during a golf swing. As indicated previously, each foot tends to be pushed outward during a golf swing. The layout of the outsole 20 provides for three rows of cleats on each shoe which are oriented so that the 90° face is opposing the force on the feet of the golfer thus providing sufficient traction during the golf swing.

Figure 8B:
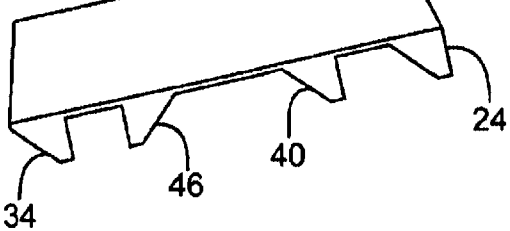
FIGS. 8A, 8B and 8C shows a cross sectional view at section mark B—B of the action of a right golf shoe during the execution of a golf swing.
Figure 8A:
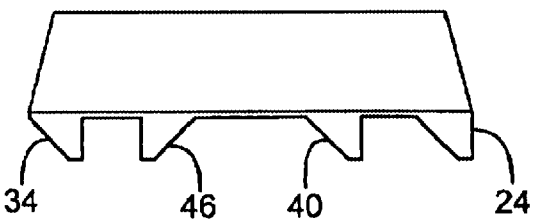
Figure 8C:
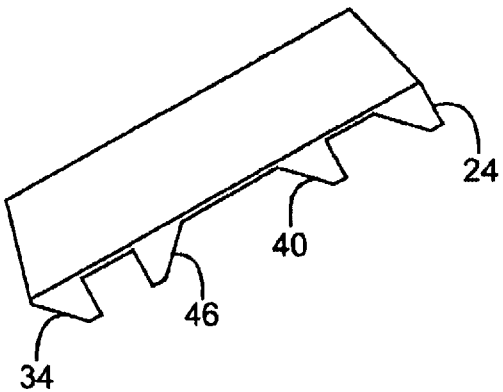

FIGS. 8A, 8B and 8C show the action of a right shoe for a right handed golfer during the striking of a golf ball (FIG. 8A), halfway through the follow through (FIG. 8B) and the completion of the golf swing (FIG. 8C). As can been seen from FIGS. 8A–8B, in a properly executed golf swing, up until and including the point of actually striking the ball, the right foot remains on the ground and needs a source of traction to prevent it from slipping outward. The three rows of cleats 34, 40, and 24 provide the necessary traction because the 90° face is positioned so that it resists the outward force on the feet. After striking the ball however, the right foot must roll, pivoting on the inside of the right foot near the ball part of the foot. The orientation of row 34 as depicted in FIGS. 8A, 8B and 8C with the 45° face pointed toward the inner periphery of the outsole 20 allows the right foot to roll accordingly throughout the follow through of the golf swing without the full resistance that a 90° face would provide. The mechanics are similar for a left shoe and a left-handed golfer.

In one preferred embodiment, as described above, there is a row of cleats 40 formed offset from the outer periphery of the outsole 20 and another row of cleats 46 formed offset from the inner periphery of the outsole 20. Both rows 40, 46 are designed to provide additional traction during a golf swing for either a right-handed or left-handed golfer. Both row 40 and row 46 are formed approximately ½" from the outer and inner peripheries of the outsole 20 respectively and are approximately parallel to the first row 24 and the second row 34, respectively. The cleats which make up row 40 and row 46 have the same geometry as typical cleat 80 described above. For both row 40 and row 46, the 90° face of the cleat is facing the closest periphery of the golf shoe. Specifically, the 90° face of the cleats in row 40 face the outer periphery of the outsole 20 while the 90° face of the cleats in row 46 face the inner periphery of the outsole 20. Together, row 40 and row 46 provide additional traction to a golfer during a golf swing. The 90° face of the cleats provide additional resistance to the force of a golfer's feet spreading outward during a golf swing.

Figure 3:
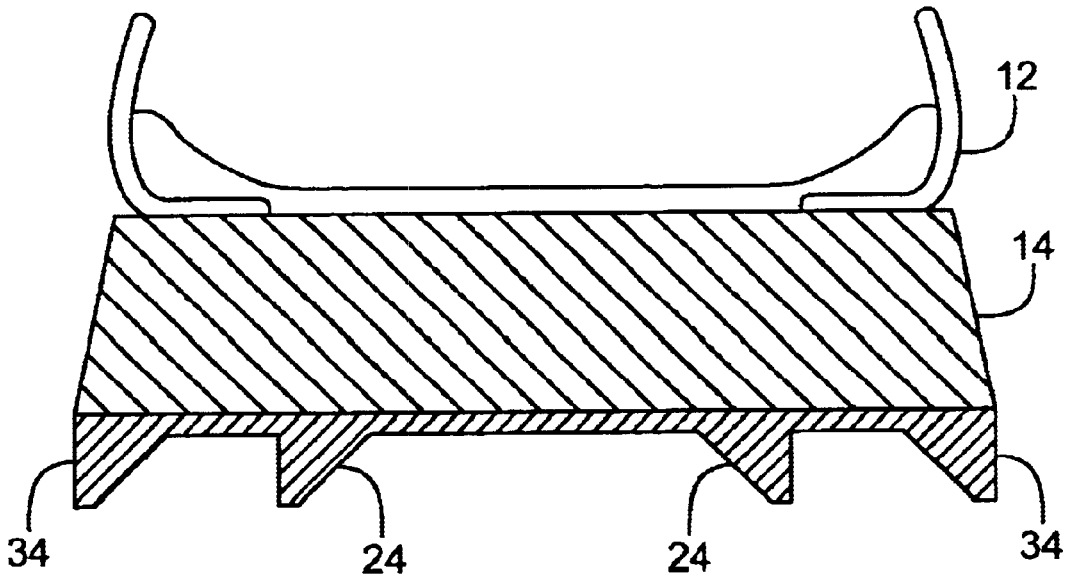
FIG. 3 is a cross sectional view of the spikeless golf shoe in FIG. 1 and FIG. 2 at section mark A—A including the upper portion of the golf shoe the middle portion, the outsole portion, and the arrangement of the cleats at section mark A—A.

Referring to FIG. 3, a cross section is shown of the golf shoe 10 shown in FIG. 1 and FIG. 2 at section A—A including upper portion 12, midsole portion 14 and outsole portion 20. Section A—A is taken at the heel portion 28 of the outsole 20. This cross section is identical for either right or left shoes as the orientation of the cleats is identical at this section of the outsole. FIG. 3 also shows the orientation of the 45°/90° faces of the cleats which make up rows 24 and 34. In the heel portion 28 of the outsole 20, the cleats are arranged so as to provide traction during a golf swing. Row 24 has the 90° face pointing toward the peripheries of the outsole 20 in both locations it appears in the cross-section in FIG. 3. Row 24 appears twice in the cross-section because in this preferred embodiment, as described above, row 24 begins on the outer periphery and loops around to a location offset from the inner periphery while maintaining the 90° face outward toward each periphery. Likewise row 34 is shown with the 90° face pointing toward the peripheries of the outsole 20 in both locations it appears in the cross-section in FIG. 3. Row 34 appears twice in the cross-section because in this preferred embodiment, as described above, row 34 begins on the inner periphery and continues around the circumference of the heel portion 28 to a location on the outer periphery.

In FIG. 3, all of the cleats are arranged so as to provide traction during a golf swing, thus all of the 90° faces point toward the periphery of the outsole. Since the rolling action required during the follow through of a golf swing occurs in the front portion of the outsole there is no need to provide a 45° face, for a rolling action, in the heel portion of the outsole. Instead, the cleats are used to provide the required traction during the golf swing. Two rows have the 90° faces pointing toward the inner periphery and two rows have the 90° faces pointing toward the outer peripheries. This arrangement allows for equal traction for a right-handed or left-handed golfer.

Figure 4:
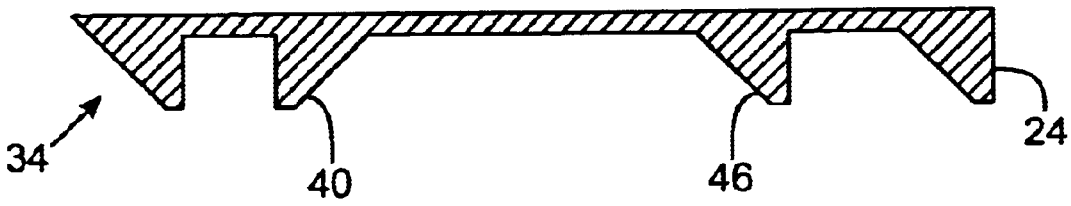
FIG. 4 is a cross sectional view of the spikeless golf shoe in FIG. 1 and FIG. 2 at section mark B—B showing only the outsole and the arrangement of the cleats at section mark B—B.

Referring to FIG. 4, a cross-section is shown of the outsole portion 20 as shown in FIGS. 1 and 2 at section B—B. Section B—B is taken in the front portion 26 of outsole 20. The cross-section in FIG. 4 shows the cleat arrangement for a right shoe only. In this area of the outsole, provisions were made to accommodate the rolling action required during the follow through of a golf swing. As discussed above, for a right handed golfer, the inner periphery of the right shoe needs to be able to roll during the follow through of a golf swing. In FIG. 4, row 34 has the 45° face pointing toward the inner periphery to allow for this rolling action. The area of row 34 proximate to the front portion 26 of outsole 20 is the only area where accommodations need to be made for the rolling action. For a left golf shoe in FIG. 4, the orientation of rows 34 and 24 would each be reversed to similarly allow for a rolling action during the follow through of a left handed golfer.

Figure 5B:
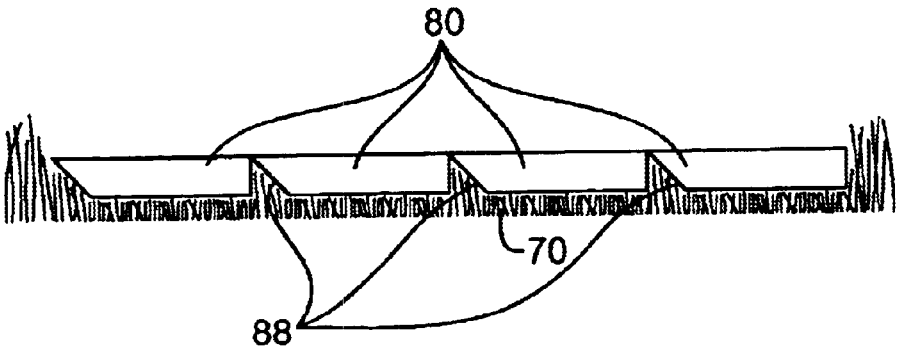
FIG. 5B is a lengthwise cross sectional view of an individual row of interconnected cleats when placed on a location such as grass located on a golf course.
Figure 5A:
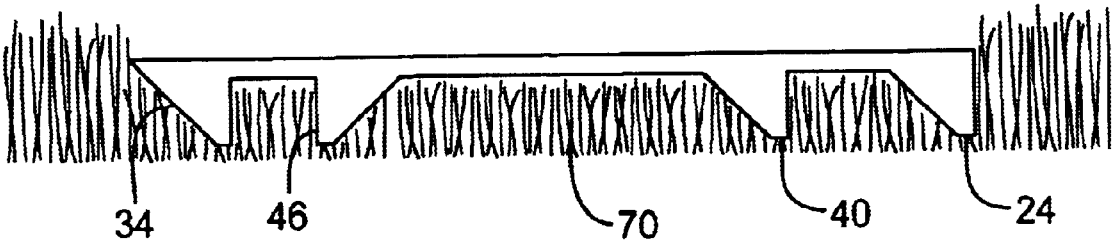
FIG. 5A is a cross sectional view of the outsole including the arrangement of the cleats at section mark B—B when placed on a location such as grass located on a golf course.

Referring to FIG. 5A, a cross section is shown of the outsole portion 20 as shown in FIGS. 1 and 2 at section B—B. Section B—B is taken in the front portion 26 of outsole 20. The cross-section in FIG. 5A shows the cleat arrangement for a right shoe while in contact with a grass surface 70. FIG. 5A shows how rows 34, 46, 40 and 24 of cleats sink into a grass surface which could be the green area of a golf course. The lengthwise trapezoidal cross section of the cleats 80 provides a wedge shape and allows the cleats to more easily sink into the grass surface 70 thus providing more surface area for traction purposes. FIG. 5B shows a lengthwise cross section of a row of cleats 80 showing the slots 88 formed between them and how they interconnect and sink into a grass surface 70.

Referring again to FIG. 6A, the top face 82 of the cleat 80 provides an approximately flat surface to provide increased stability when walking on a hard surface. Golf shoes are not typically worn just on the golf course and on grass surfaces. Rather, the shoes are worn from the car to the golf course on asphalt, on concrete surfaces, on carpeted surfaces and on hard dirt surfaces. The top face 82 of the cleat 80 is designed to give the support needed when walking on these hard surfaces. While a cleat which comes to a point rather than utilizing a top face 82 as in the present invention might provide suitable traction, the point would noticeably wear more quickly and would not give a golfer the needed support on hard surfaces. The present invention therefore utilizes the top face 82 to provide for better wear and increased stability on hard surfaces.

Referring now to FIG. 2, the area 44 on row 34 near the bottom of the heel portion 28 has an increased top face surface area. This is an area of the outsole 20 which experiences greater than normal wear when walking on hard surfaces. This is typically referred to as the heel strike area. The outsole 20 tends to wear the greatest and quickest in area 44 so in one preferred embodiment, additional outsole material has been utilized in this area to give more support to the golfer and more life to the shoe.

Figure 9:
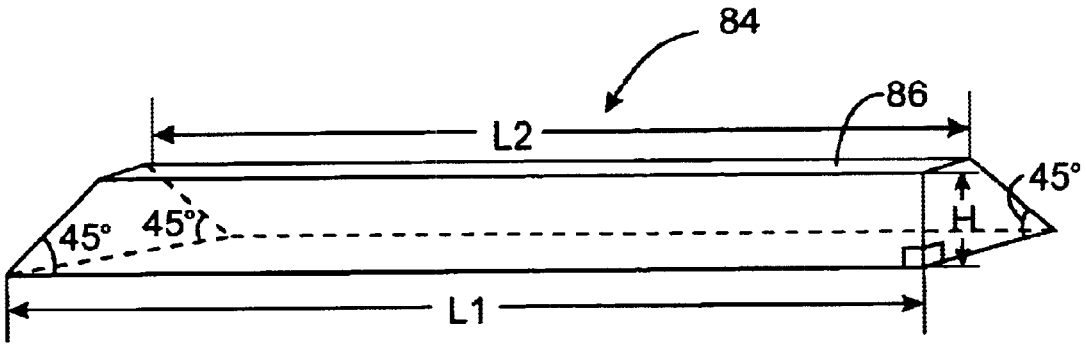
FIG. 9 show the geometry of a typical laterally placed individual cleat.

In FIG. 2 the individual laterally placed cleats 50–55, 60–62 and 56 have the same typical geometry as described above for cleat 80 in FIG. 6A and are represented independently at 84 in FIG. 9. The individual lateral cleats 50–55, 60–62 and 56 are located with the 90° face toward the rear of the golf shoe 10 and outsole 20. The length L1 at the base of cleat 84 can vary depending on its location on the outsole. A typical lateral cleat would have a length L1 between ½" and 3" with length L2 at the top of the cleat slightly shorter than L1. The size of the spikeless golf shoe 10 itself and the corresponding size of the outsole 20 would affect the lengths of the individual cleats 84.

In FIG. 2,the cleats 50–55 and 60–62 are mainly provided for traction while walking forward on a flat surface or up a hill or steep incline. When walking up a hill or incline, the force of gravity will push the golfer's foot back down the hill causing his or her foot to slip backwards. With the 90° face of the cleats facing the rear of the spikeless golf shoe 10, this force is resisted and substantial traction is gained. Cleat 56 in FIG. 2 is provided for additional traction when walking up a steeper incline. On very steep slopes, the foot tends to bend and most of the golfer's weight is placed on the front portion of the outsole 20. Cleat 56 is provided for those situations where the golfer may only be walking on the front of the outsole 20 and the lateral cleats 60–62 do not contact the ground. Being located at the very front of outsole 20, cleat 56 allows for additional traction in steep slope situations.

The series of lateral cleats 50–55 and 60–62 also provide for consistent support for the golfer throughout the entire area of the outsole 20. Without the lateral cleats 50–55 and 60–62, there would be an uneven distribution of weight across the foot and consequentially uneven support to the golfer.

Figure 6D:
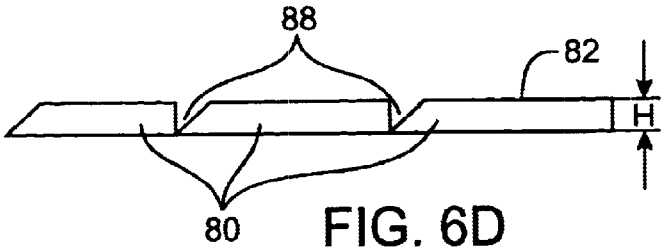
FIG. 6D shows an arrangement of several individual cleats as they would appear when interconnected on the bottom of the outsole in FIG. 2.

Several desirable aspects of the geometry and orientation of the cleats allows the present invention to provide traction superior to previous attempts at spikeless golf shoes, as well as providing substantial protection to the grass surfaces on a golf course. When placed end to end in a row as depicted in first row 24, second row 34, third row 40 and fourth row 46, the lengthwise trapezoidal cross-section of the typical cleat 80 provides a small slot in between the individual cleats. FIG. 6D depicts the assembly of several cleats in a row and shows the slots 88 in between the cleats. These slots serve two functions. First, they allow each cleat typically shown at 80 to more easily sink into the grass surface and provide traction. Without the slots in between the cleats, the traction would not be as effective because the cleats could not sink into the grass as well. In this situation, the shoe could tend to slide rather than grip. Since the cleats have a lengthwise trapezoidal cross section as well as a widthwise trapezoidal cross section, the cleat is more able to secure itself into the grass surface when under the pressure of a golfer's weight.

Second, the slots serve as a means of adding flexibility to the outsole 20 and to the entire spikeless golf shoe 10. As a person walks, the outsole of the shoe tends to bend around the flexing of the foot. Without slots or breaks in the cleats, the cleats would serve to restrict this natural motion and make the shoe much stiffer. The incorporation of the slots into the layout of the rows of cleats provides increased flexibility and thus greater comfort to the golfer.

Another aspect of the present invention is that the cleats which provide the traction can be located at or near the periphery of the outsole. Previous versions of golf shoes typically had the cleats or spikes approximately ½" to ⅝" from the periphery of the outsole. This aspect of prior golf shoes effectively reduces the area available for providing traction and is consequentially inefficient at doing the same. With the present invention, some of cleats which provide traction are able to be placed at or near the very edge of the outsole, effectively giving the golfer a wider effective area of support and traction.

Figure 10A:
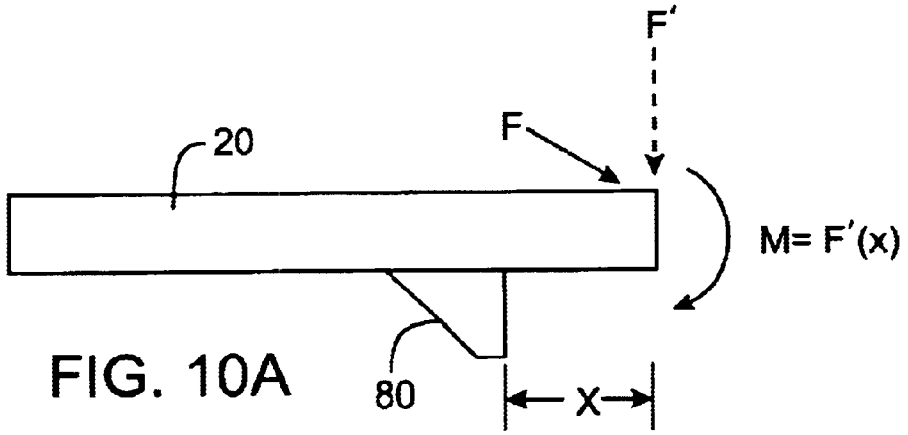
FIG. 10A illustrates the twisting moment generated when a cleat is located at a distance offset from the periphery of the outsole.
Figure 10B:
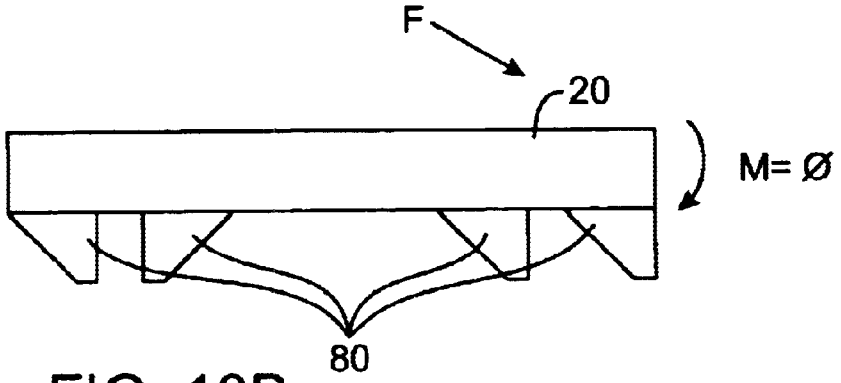
FIG. 10B illustrates the elimination of the twisting moment when a cleat is located at the periphery of the outsole.

As discussed above, during a golf swing, the golfer's feet tend to be pushed outward as a result of the force translating down the leg of a golfer. FIG. 10A shows what happens when the cleat causing a resistive force is moved away from the periphery of the outsole. A twisting moment force M is generated whenever there is a distance x between the outermost cleat and the periphery of the outsole. As the distance x increases, so does the twisting moment force. This moment force tends to roll the golf shoe and consequentially the golfer's feet to the outside. This undesirable result can have detrimental effects on the quality of a golf swing. By locating some of the traction providing cleats 80 at or near the periphery of the outsole, the distance x as shown in FIG. 10B is effectively eliminated or reduced to an insignificant amount. By placing the cleats at the periphery of the outsole 20, this embodiment of the present invention eliminates the generation of a twisting moment and the potential for loss of traction.

As an example, an outsole 20 attached to a men's size 10 golf shoe and incorporating the rows of cleats and individual lateral cleats provides approximately 65" of cleats hitting the grass surface. This large area of cleats coming into contact with the grass surface combined with the ability to attach the cleats to the very periphery of the outsole 20, allows the overall height of the cleat H to be reduced significantly without sacrificing the required performance needed for traction. The result is that the shorter cleat does not leave the "spike mark" in the putting surface as the golfer walks upon that surface. The taller that the cleats are, the more those cleats will sink into the putting surface and the greater potential there is for a spike mark. The small amount of cleat embedment needed with the present invention reduces or eliminates the spike mark problem to the putting surface, even with a careless golfer who may drag or twist his feet.

The spacing of the rows of cleats 24, 40, 46 and 34 as shown in FIG. 2, as well as the spacing between the individual laterally placed cleats 50–55, 60–62 and 56 makes the outsole 20 very easy to clean. Since the height H of the cleats 80 is typically only ⅛" combined with the fact that the rows of cleats are spaced apart from each other by ½"–¾", debris and mud do not tend to collect on the bottom of the sole. Typical spiked golf shoes and prior versions of spikeless golf shoes had areas on the sole which tended to collect debris and mud very easily.

In one embodiment of the present invention, the outsole 20 is made by first creating a sketch of what the sole should look like. Using EVA rubber, strips of material are cut that have a 90° face on one side and a 45° face on the other. A flat piece of rubber is then glued onto the shape of the sole and the strips are glued onto the sole in the appropriate cleat configurations. Slits are then cut into the rubber strips to achieve the exact layout of the rows of cleats and the individual cleats thus providing the lengthwise cross section. This form is peeled off, glued into a trough which has a ½" curb around the outside and the trough is then filled with silicone rubber. When the silicone hardens, it is peeled out resulting in a mold of the outsole form. A urethane material is mixed with a hardener in a resin, mixed with a coloring agent and then poured into the silicone mold. When this mixture has hardened, the result is an outsole for the spikeless golf shoe.

As has been described, in one preferred embodiment, the present invention provides an outsole for use with a shoe intended for wearing on a surface such as natural or artificial grass while the user is engaged in sports or other energetic activities. The outsole comprises an elongate sole structure having a bottom; a traction structure depending below the bottom, the traction structure comprising at least one bi-directional surface reaction body having a first face and a second face, the bi-directional surface reaction body having an apex portion which merges with the first and second faces; the first face extends upwardly from the apex portion and joins with the bottom at a first angle which is sufficiently upright relative to the bottom to enable the first face to create substantial traction with the surface responsive to force components which are applied against the shoe for urging the bi-directional body in one horizontal direction; and the second face extends upwardly from the apex portion and joins with the bottom at a second angle which is sufficiently inclined relative to the bottom to enable the second face to have insubstantial traction with the surface responsive to force components which are applied against the shoe for urging the bi-directional surface reaction body in an other horizontal direction.

Preferably, the first angle is approximately 90°; however actual angle could be otherwise, such as in the range of from substantially 80° to 100°. Similarly, the second angle is approximately 45°, but could be in a range of from substantially 40° to 50°. The one horizontal direction is substantially opposite the other horizontal direction, and the first and second faces are preferably disposed on opposite sides of the cleat body.

The outsole includes a medial side having an outer margin, and in which the traction structure further includes a plurality of the bi-directional surface reaction bodies disposed in spaced-apart relationship along a first row, the first row extending along the outer margin with the first faces of the bi-directional surface reaction bodies in the first row facing outwardly from the medial side.

The outsole includes a lateral side having an outer margin, and in which the traction structure further comprises a plurality of the bi-directional surface reaction bodies disposed in spaced-apart relationship along a first row, the first row extending along the outer margin with the first faces of the bi-directional surface reaction bodies in the first row facing outwardly from the lateral side.

The outsole includes a medial side having an outer margin, and in which the traction structure further includes a plurality of the bi-directional surface reaction bodies disposed in spaced-apart relationship along a first row, the first row extending along the outer margin with the second faces of the bi-directional surface reaction bodies in the first row facing in a direction extending outwardly from the medial side.

The outsole includes a lateral side having an outer margin, and in which the traction structure further comprises a plurality of the bi-directional surface reaction bodies disposed in spaced-apart relationship along a first row, the first row extending along the outer margin with the second faces of the bi-directional surface reaction bodies in the first row facing in a direction extending outwardly from lateral side.

The outsole has a forefoot portion with a lateral side and a medial side, the traction structure further including a plurality of the bi-directional surface reaction bodies disposed in spaced-apart relationship along a first row, the first row extending along the lateral side, and a second plurality of the bi-directional surface reaction bodies disposed in spaced-apart relationship along a second row, the second row extending along the medial side.

The outsole has a heel portion with a lateral side and a medial side, the traction structure further including a plurality of the bi-directional surface reaction bodies disposed in spaced-apart relationship along a first row, the first row extending along the lateral side of the heel portion, and a second plurality of the bi-directional surface reaction bodies disposed in spaced-apart relationship along a second row, the second row extending along the medial side of the heel portion. In a preferred embodiment, the first and second faces of the bi-directional surface traction structure are substantially flat.

The outsole is intended for use with the upper of a golf shoe wherein the outsole has a forefoot portion with a lateral side and a medial side, the outsole further characterized in that the traction structure comprises a first plurality of the bi-directional surface reaction bodies disposed in spaced-apart relationship along a first row which extends along the lateral side of the forefoot portion, the first faces in the first row facing outwardly from the lateral side, and a second plurality of the bi-directional surface reaction bodies disposed in spaced-apart relationship along a second row which extends along the medial side of the forefoot portion, the second faces in the second row facing outwardly from the medial side.

The outsole is intended for use with the upper of a golf shoe wherein the outsole has a heel portion with a lateral side and a medial side, the outsole further characterized in that the traction structure comprises a first plurality of the bi-directional surface reaction bodies disposed in spaced-apart relationship along a first row which extends along the lateral side of the heel portion, the first faces in the first row facing outwardly from the lateral side, and a second plurality of the bi-directional surface reaction bodies disposed in spaced-apart relationship along a second row which extends along the medial side of the the heel portion, the second faces in the second row facing outwardly from the medial side.

Then outsole is intended for use with the upper of a golf shoe wherein the outsole has a forefoot portion with a lateral side and a medial side and a heel portion with a lateral side and a medial side, the outsole further characterized in that the traction structure comprises a first plurality of the bi-directional surface reaction bodies disposed in spaced-apart relationship along a first row which extends along the lateral side of the forefoot portion, the first faces in the first row facing outwardly from the lateral side, and a second plurality of the bi-directional surface reaction bodies disposed in spaced-apart relationship along a second row which extends along the medial side of the forefoot portion, the second faces in the second row facing outwardly from the medial side, a third plurality of the bi-directional surface reaction bodies disposed in spaced-apart relationship along a third row which extends along the lateral side of the heel portion, the first faces in the third row facing outwardly from the lateral side, ad a fourth plurality of the bi-directional surface reaction bodies disposed in spaced-apart relationship along a fourth row which extends along the medial side of the heel portion, the first faces in the fourth row facing outwardly form the medial side.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A spikeless golf shoe comprising:

an outsole;

a first row of a plurality of spikeless cleats disposed at an outer periphery of the outsole and extending from a front of the outsole past a ball portion of the outsole to approximately an arch portion of the outsole;

a second row of a plurality of spikeless cleats disposed substantially parallel to and spaced from the first row of cleats, the second row of cleats extending from the front of the outsole past a ball portion of the outsole to approximately an arch portion of the outsole;

wherein each of the cleats in the first and second rows comprise substantially rigid protrusions having a length substantially parallel to the outer periphery of the outsole and a width which is less than ½ the length, a cross section of each of the cleats in the width direction being substantially triangular, a first side of each of the cleats facing toward the outer periphery of the outsole forming a substantially 90° angle with the outsole, and a second side of each of the cleats facing away from the outer periphery of the outsole forming a substantially 45° angle with the outsole.

2. The spikeless golf shoe of claim 1, wherein the first and second rows of spikeless cleats are formed on a lateral side of the outsole.

3. The spikeless golf shoe of claim 2, further comprising:

a third row of a plurality of spikeless cleats disposed at an outer periphery of the outsole on a medial side of the outsole;

a fourth row of a plurality of spikeless cleats disposed substantially parallel to and spaced from the third row of cleats, wherein each of the cleats in the third and fourth rows comprise substantially rigid protrusions having a length substantially parallel to the outer periphery of the outsole and a width, a cross section of each of the cleats in the width direction being substantially triangular.

4. The spikeless golf shoe of claim 3, wherein a first side of each of the cleats in the third row facing toward the outer periphery of the outsole forms a substantially 45° angle with the outsole and a second side of each of the cleats in the third row facing away from the outer periphery of the outsole forms a substantially 90° angle with the outsole.

5. The spikeless golf shoe of claim 3, wherein a first side of each of the cleats in the fourth row facing toward the outer periphery of the outsole forms a substantially 90° angle with the outsole, and a second side of each of the cleats in the fourth row facing away from the outer periphery of the outsole forms a substantially 45° angle with the outsole.

6. The spikeless golf shoe of claim 1, wherein the first side of each of the cleats is substantially planar.

7. The spikeless golf shoe of claim 6, wherein the second side of each of the cleats is substantially planar.

8. The spikeless golf shoe of claim 1, wherein a base of each of the cleats adjacent the outsole contacts the base of an adjacent cleat.

9. The golf shoe of claim 1, wherein the plurality of spikeless cleats in the first row are interconnected.

10. The spikeless golf shoe of claim 1, wherein the plurality of spikeless cleats in the second row are interconnected.

11. The spikeless golf shoe of claim 1, further comprising a plurality of non-interconnecting cleats arranged laterally and spaced apart on the ball portion of the outsole.

12. The spikeless golf shoe of claim 1, wherein the laterally arranged non-interconnecting cleats have a length in a transverse direction and a substantially trapezoidal cross-section in a width direction.

13. A spikeless golf shoe comprising:

an outsole;

a first row of a plurality of spikeless cleats disposed at an outer periphery of a lateral side the outsole and extending from a front of the outsole past a ball portion of the outsole to approximately an arch portion of the outsole;

a second row of a plurality of spikeless cleats disposed substantially parallel to and spaced from the first row of cleats, the second row of cleats extending from the front of the outsole past a ball portion of the outsole to approximately an arch portion of the outsole;

a third row of a plurality of spikeless cleats disposed at an outer periphery of a medial side the outsole and extending from a front of the outsole past a ball portion of the outsole to approximately an arch portion of the outsole;

a fourth row of a plurality of spikeless cleats disposed substantially parallel to and spaced from the first row of cleats, the second row of cleats extending from the front of the outsole past a ball portion of the outsole to approximately an arch portion of the outsole;

wherein each of the cleats in the first, second, third, and forth rows comprise substantially rigid protrusions having a length substantially parallel to the outer periphery of the outsole and a width substantially perpendicular to the length, a cross section of each of the cleats in the width direction being substantially triangular, a first side of each of the cleats forming a substantially 90° angle with the outsole, and a second side of each of the cleats forming a substantially 40° to 50° angle with the outsole.

14. The spikeless golf shoe of claim 13, wherein the first side of each of the cleats is substantially planar.

15. The spikeless golf shoe of claim 13, wherein the second side of each of the cleats is substantially planar.

16. The spikeless golf shoe of claim 13, wherein each of the cleats in the first and second rows has a base of the cleat adjacent the outsole which contacts the base of an adjacent cleat.

17. A spikeless golf shoe of claim 1, wherein the plurality of spikeless cleats in the first and second rows are interconnected.

18. A spikeless golf shoe of claim 17, wherein the plurality of spikeless cleats in the third and fourth rows are interconnected.

19. The spikeless golf shoe of claim 18, further comprising a plurality of non-interconnecting cleats arranged laterally and spaced apart on the ball portion of the outsole.

* * * * *

UNITED STATES PATENT AND TRADEMARK OFFICE

CERTIFICATE OF CORRECTION

PATENT NO. : 6,615,512 B2
APPLICATION NO. : 09/982117
DATED : September 9, 2003
INVENTOR(S) : Jeffrey A. Sink It is certified that error appears in the above-identified patent and that said Letters Patent is hereby corrected as shown below:

On the title page, item [63]:
In the section "Related U.S. Application Data", add the following before "Provisional application No. 60/048,836, filed on Jun. 6, 1997.":

--Continuation of application No. 08/971,476, filed on Nov. 14, 1997, now abandoned.--

Signed and Sealed this

Twenty-second Day of May, 2007

JON W. DUDAS
*Director of the United States Patent and Trademark Office*